US006237609B1

(12) United States Patent
Vasas

(10) Patent No.: US 6,237,609 B1
(45) Date of Patent: May 29, 2001

(54) CURVED LONGITUDINAL PROFILE MASCARA BRUSH

(75) Inventor: Martin M. Vasas, Fairfield, CT (US)

(73) Assignee: The Bridgeport Metal Goods Manufacturing Company, Stratford, CT (US)

( * ) Notice: Subject to any disclaimer, the term of this patent is extended or adjusted under 35 U.S.C. 154(b) by 0 days.

(21) Appl. No.: 09/404,894

(22) Filed: Sep. 24, 1999

(51) Int. Cl.[7] ..... A45D 40/26; A45D 40/24
(52) U.S. Cl. ..... 132/218; 132/320; 132/317
(58) Field of Search ..... 132/218, 313, 132/320, 216, 217, 317; 401/126, 122; 15/167.1, 206

(56) References Cited

U.S. PATENT DOCUMENTS

| | | | | |
|---|---|---|---|---|
| 5,067,195 | * | 11/1991 | Sussman | 15/167.1 |
| 5,137,038 | * | 8/1992 | Kingsford | 132/218 |
| 5,309,929 | * | 5/1994 | Toll | 132/218 |
| 5,492,136 | * | 2/1996 | Edmonds | 132/218 |
| 5,860,432 | * | 1/1999 | Gueret | 132/218 |
| 5,873,669 | * | 2/1999 | Poore et al. | 401/122 |
| 5,876,138 | * | 3/1999 | Gueret | 401/129 |
| 5,894,847 | * | 4/1999 | Gueret | 132/218 |
| 5,934,292 | * | 8/1999 | Gueret | 132/218 |
| 6,003,519 | * | 12/1999 | Gueret | 132/218 |

* cited by examiner

*Primary Examiner*—Nicholas D. Lucchesi
*Assistant Examiner*—Robyn Kieu Doan
(74) *Attorney, Agent, or Firm*—Wake, Fressola, Van Der Sluys & Adolphson LLP

(57) ABSTRACT

A mascara brush has a wire core securing bristles extending radially therefrom. The bristles are trimmed to define applicator bristles and bristles extending in a longitudinal profile comb deployed along the core, the profile comb being longer than the applicator bristles. The core is curved in a plane passing through the profile comb whereby bristles extending from the convex side of the curved core diverge and bristles extending from the concave side of the curved core converge. The profile comb has a flat comb surface extending across its width, and the comb surface longitudinally curves to generally conform to eyelashes. For applying quick drying building or curling mascara, the profile comb extends from the concave side of the curved core. For applying heavier defining mascaras, the profile comb extends from the convex side of the core. The brush has bristles along one inch of its length, the bristles being secured in approximately sixteen turns of the brush at a density of 45 to 65 bristles per turn. The bristles are a 0.005 inch diameter hollow tubular bristle with three lobes on the exterior. The bristles defining the profile comb are approximately two times the length of the applicator bristles.

36 Claims, 5 Drawing Sheets

FIG.5
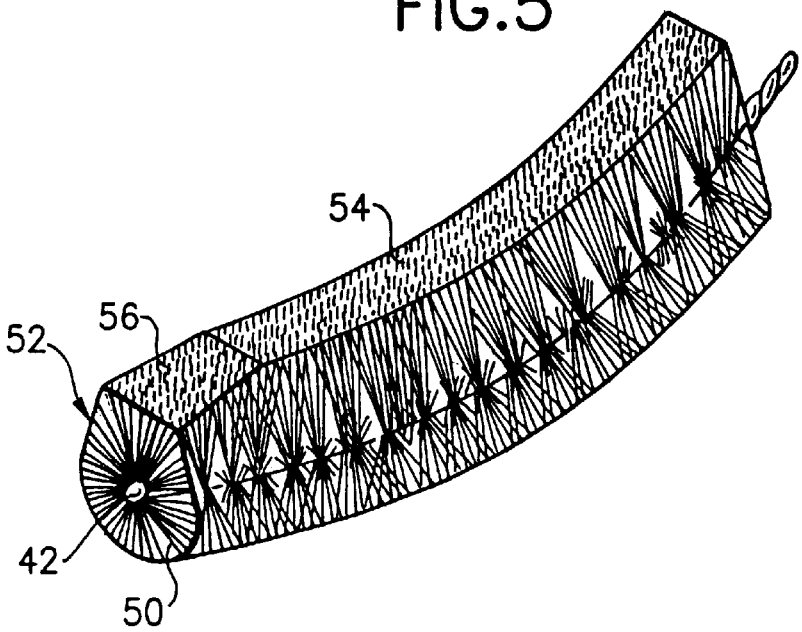
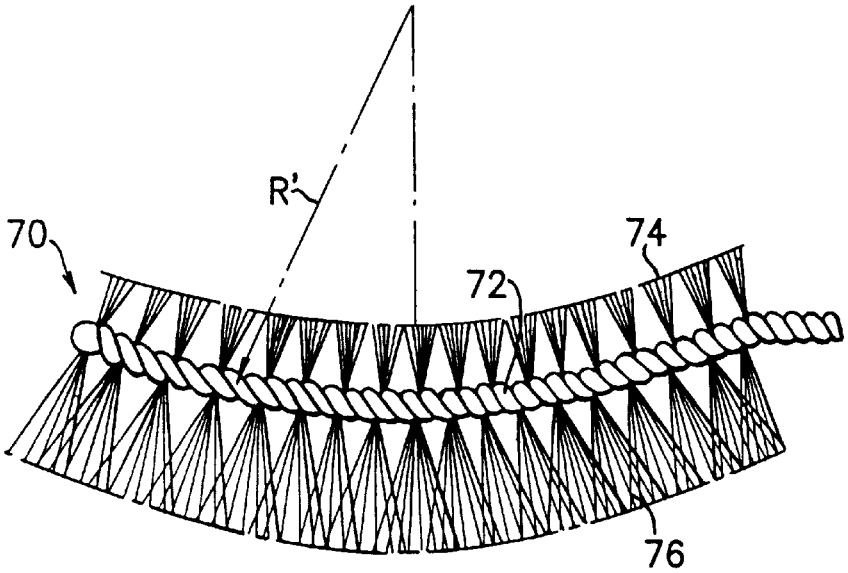
FIG.8
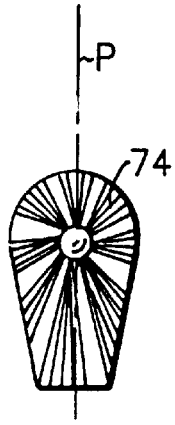
FIG.9

FIG. 10
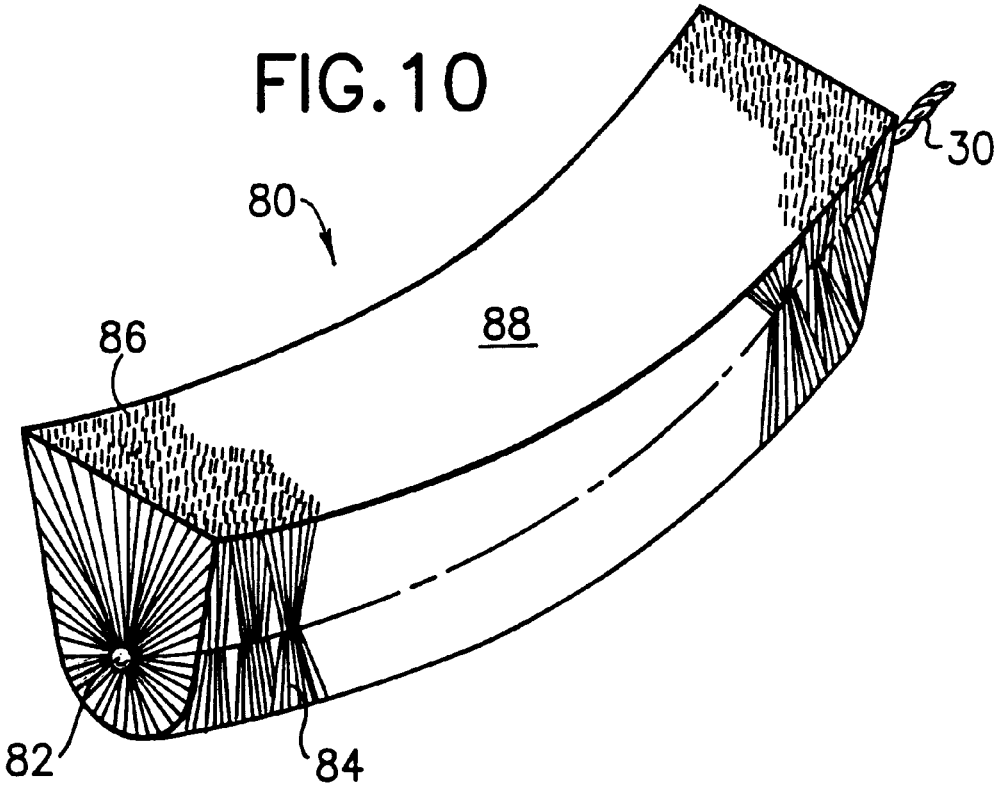
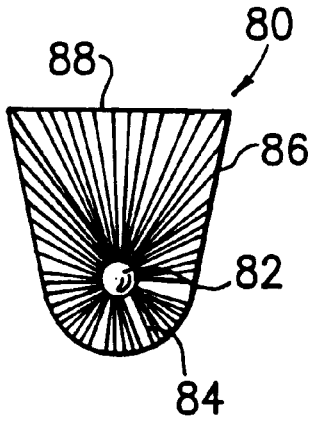
FIG. 11

CURVED LONGITUDINAL PROFILE MASCARA BRUSH

FIELD OF THE INVENTION

The invention herein relates to a curved longitudinal profile mascara brush, the orientation of the bristles with respect to the curve adapting the brush for application of lighter, quick drying curling and building mascara products or to heavier high prominence mascara products.

BACKGROUND OF THE INVENTION

Mascara is formulated for a wide variety of effects when applied to a user's eyelashes. One mascara is known as a curling or building formula. It is generally of lighter viscosity and is quick drying on the eyelashes, having a setup time generally in the range of three to five seconds. Such mascara is ideally applied in several coats, and the mascara brush used to make the application must first deposit the mascara on the eyelashes and then comb the eyelashes into an uplifted curved configuration as the mascara dries, so that the mascara can hold the eyelashes in that desired position. Thereafter, one or more additional coats of the mascara may be applied, until the eyelashes are sufficiently stiffened in their uplifted curled position.

Mascara brushes generally comprise a twisted wire core that secures bristles therebetween, the bristles extending radially outwardly to bristle ends. The mascara brush is preferably capable of both applying the mascara product and combing the mascara product after it has been applied. Many different types of bristles and configurations of brushes have been brought forward in an effort to satisfy those two, often inconsistent goals. None of these brushes has achieved a desired level of success in applying the curling or building products.

On the other hand, some mascara products are heavier and are designed with slower drying times, on the order of seven and even ten or more seconds. These products are used to enhance the appearance of thin or light colored eyelashes where a thick coat of the mascara is required. Successful application involves placing a substantial amount of the heavier mascara on the eyelashes, followed by combing the eyelashes to separate them and evenly distribute the mascara product. Again, mascara brushes with many bristle types and configurations have been proposed for such mascaras with some success, but improvement is still awaited in the industry.

One of the prior configurations is a curved mascara brush. The curve permits contact of the brush with more eyelashes along a correspondingly curved eyelid. Another configuration is the longitudinal profile brush, in which the brush is trimmed to an asymmetric cross sectional shape. The shape typically has some longer and some shorter bristles and is accomplished in a straight wire brush. None of these brushes excelled at applying the curling or building mascaras, and also do not provide a brush for the heavier mascaras either.

SUMMARY OF THE INVENTION

It is a principal object of the invention herein to provide an improved mascara brush.

It is an additional object of the invention herein to provide a mascara brush that is well adapted to applying curling or building mascaras.

It is an another object to the invention herein to provide a mascara brush that is well adapted to applying heavier coating mascaras.

It is a further object of the invention herein to provide a mascara brush that maximizes application and combing functions, especially when used with mascaras at the ends of the mascara product range.

It is yet another object of the invention herein to provide a mascara brush which is convenient and efficient to the user.

It is an additional object of the invention herein to provide a mascara container including a mascara brush of the above character, wherein the container and mascara brush cooperate to provide an appropriate amount of mascara on the brush as it is removed for use.

In carrying out these and other objects of the invention, a mascara brush is provided including a twisted wire core for securing bristles extending generally radially therefrom. The bristles are trimmed to define applicator bristles and longer bristles extending in an asymmetric profile comb deployed along the wire core. The applicator bristles have a substantially uniform length and the bristles defining the profile comb have a different, longer substantially uniform length. The core is curved in a plane passing through the profile comb, whereby the bristles extending from the convex side of the curved core diverge and separate toward their tips and the bristles extending from the concave side of the curved core converge and close together toward their tips.

According to one aspect of the invention, the profile comb extends from the concave side of the curved core, adapting the brush for application of curling or building mascaras. According to another aspect of the invention, the profile comb extends from the convex side of the curved core, adapting the mascara brush to application of heavier coating mascaras. The curve is generally arcuate, to deploy the ends of the bristles extending from the concave side of the curved core in a curved configuration generally matching the curve of an eyelid.

According to further aspects of the invention, the profile comb has a substantially flat comb surface, enhancing the engagement of the comb with the eyelashes. The profile comb may be angularly truncated adjacent the tip end of the brush to provide a detail combing surface.

According to an additional aspect of the invention, the comb end surface has less width than the diameter of the brush in its applicator bristle portion. Alternatively the comb end surface is wider than the brush in its applicator bristle portion, providing a fan shaped asymmetric profile.

In also carrying out the objects of the invention herein, a mascara container is provided having a body with an elongated product cavity, the body including a threaded neck. A wiper is positioned in the neck and defines a wiper orifice. A cap is internally threaded for removable securement on the threaded neck of the body, and the cap mounts an applicator rod extending through the wiper orifice when the cap is on the body. A mascara brush including a curved twisted wire core having applicator bristles and bristles extending in an asymmetric profile comb is mounted at the end of the applicator rod. Mascara contained in the product cavity transfers to the brush and is partially wiped from the brush as the brush is withdrawn for application of the mascara. The wiper removes more mascara from the bristles of the extending profile comb than from the applicator bristles.

According to additional aspects of the invention, the brush has a shank inserted into the applicator rod and a tip at the distal end of the brush, the core of the brush is curved in an arc therebetween. According to a more particular aspect of the invention, the tip and the shank of the brush are disposed on the axis of the applicator rod.

According still further aspects of the invention, the bristles of the brush are dimensioned such that the brush generally self-centers in the wiper orifice as it passes therethrough, within approximately 25% of the radius of the wiper orifice from the center of the wiper orifice. According to a more particular aspect of the invention, the wiper is formed as a descending truncated cone having the wiper orifice at the truncation. The wiper is formed of a semi-rigid plastic, and the applicator rod is sized to seal to the wiper to contain the mascara between uses. Alternatively, the wiper may be fabricated of more flexible materials, such as urethanes.

Other and more specific objects and features of the invention herein will in part be understood by those skilled in the art and will in part appear in the following description of the preferred embodiments taken together with the drawings.

DRAWINGS

FIG. 5 is a perspective view of the mascara brush of FIG. 1;

FIG. 8 is a side elevation view of another mascara brush according to the invention herein;

FIG. 9 is an end view of the mascara brush of FIG. 8;

FIG. 10 is perspective view of another mascara brush according to the invention herein; and FIG. 11 is an end view of the mascara brush of FIG. 10.

The same reference numerals refer to the same elements throughout the various figures.

DESCRIPTION OF PREFERRED EMBODIMENT

Figure 1:
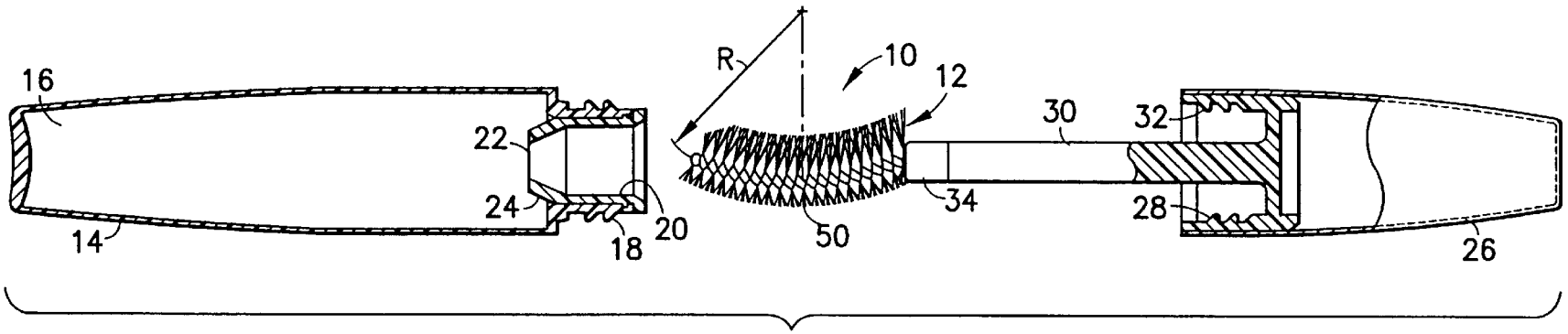
FIG. 1 is a side view, partially in section, of a mascara container including a mascara brush according to the invention herein.

FIGS. 1–7 illustrate a mascara container 10 and its mascara brush 12, according to the invention herein. The container 10 has an elongated tubular body 14 which defines a cavity 16 therein for receiving and storing mascara, not shown. The body 14 has a threaded neck 18 in which a wiper 20 is mounted. The wiper 20 defines a wiper orifice 22 providing the entry and exit passage to the product cavity 16. The portion of the wiper 24 which is adjacent to and defines the wiper orifice 22 is in the form of a truncated cone which descends from the interior of the threaded neck 20 into the cavity 16. In the embodiment shown, the wiper is fabricated of the semi-rigid plastic material, such as low density polyethylene, but the wiper may be fabricated of a more flexible material, such as urethane, in other applications.

The mascara container 10 has a cap 26 which is internally threaded at 28 adapting the cap for being secured on the threaded neck 18 of the body 14. The threads 28 are conveniently provided on a head 32 of an applicator rod 30, the head 32 being inserted into the cap to mount the applicator rod thereto and provide for attaching the cap to the body 10. The applicator rod 30 and its head 32 may be fabricated of acetal plastic. The distal end 34 of the applicator rod 30 mounts the mascara brush 12.

Figure 4:
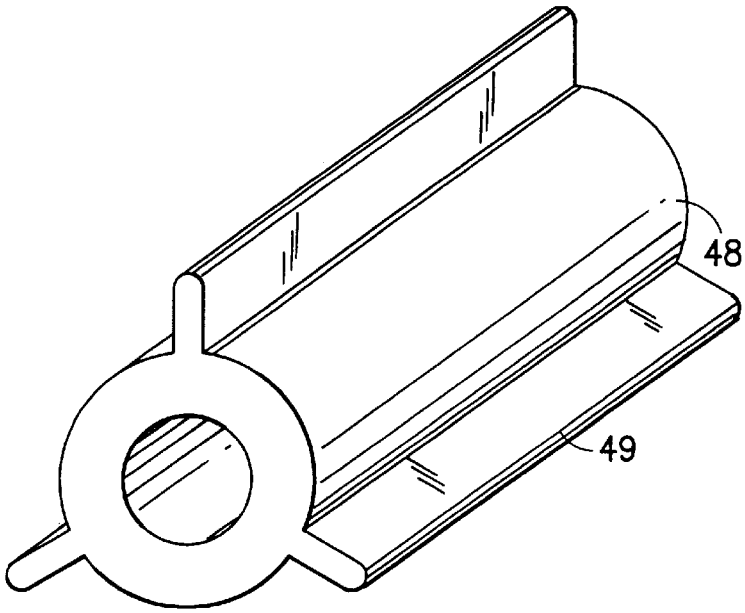
FIG. 4 is an enlarged segmental perspective view of an individual bristle of the mascara brush of FIG. 1.

The brush 12 has a twisted wire core 40 extending from a tip 42 to a shank 44, the shank being inserted into the distal end 34 the applicator rod 30 to mount the brush thereto. The tip 42 and shank 44 lie along the axis of the applicator rod. The twisted wire core 40 secures a plurality of bristles, generally indicated at 46, and the bristles extend generally radially from the twisted wire core 40. With reference to FIG. 4, a single bristle 47 is illustrated, the bristle 47 being a hollow fiber bristle with tri-lobal longitudinal ribs 49 on its exterior surface. The overall diameter of the bristles, subject to manufacturing tolerances, may be 0.005 inches, and the bristles may be made of 6.12 nylon. Such bristles have a desirable tendency to spread when captured in a twisted wire core, but are still considered as extending generally radially from the core.

The shape of the brush 12 is best illustrated in FIGS. 1–3 and 5. Before discussing the particular aspects of the shape, it should be understood that the brush 12 is manufactured with bristles 46 having a substantial length, and the bristles are thereafter trimmed to the desired shape. It will also be understood that the brush 12 is manufactured and the bristles 46 trimmed with the wire core 40 in a substantially straight configuration. The wire core 40 is bent to the arcuate shape shown in figures after the initial manufacturing and trimming of the brush. The curve of the wire core 40 is defined by the radius R. The curved wire core lies generally in a plane P, best seen in the end view of the brush shown in FIG. 2. The plane P is parallel to the drawing sheet in the views of FIGS. 1 and 3.

Figure 2:
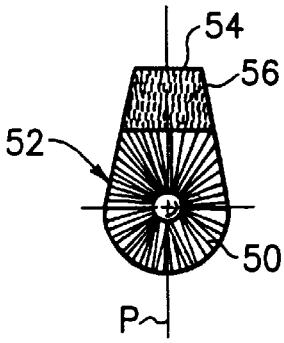
FIG. 2 is a end view of the mascara brush of FIG. 1.
Figure 3:
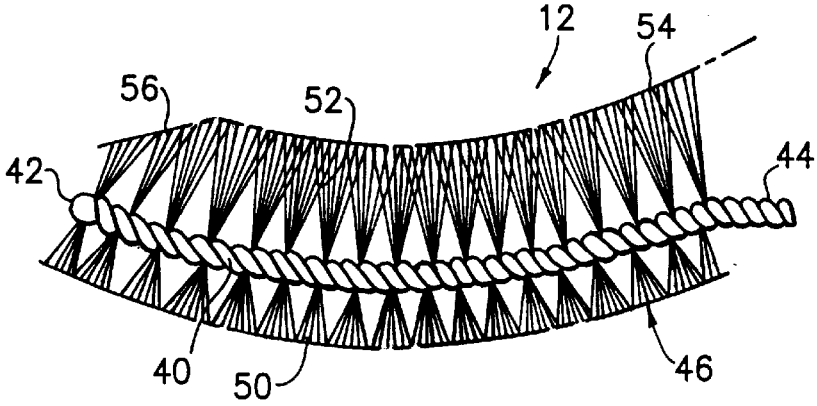
FIG. 3 is an enlarged side elevation view of the mascara brush of FIG. 1.

The bristles 46 of brush 12 include applicator bristles 50 that extend generally from the convex side of the curved twisted wire core 40. As best seen in FIG. 2, the applicator bristles 50 are deployed and extend about approximately ½ or 180° of the twisted wire core. In using the brush 12, the applicator bristles that are closer to the plane P are generally more highly involved in the application process and, because these bristles extend from the convex side of the twisted wire core, they diverge and separate toward their tips. This allows the eyelashes to be received between the applicator bristles 50 for transferring mascara from the bristles 46 to the eyelashes.

The bristles extending from the concave side of the twisted wire core provide an asymmetric longitudinal profile comb 52 which has a substantially flat comb surface 54 defined at the distal ends thereof. The profile is "asymmetric" in that it extends from one side of the brush 12 and is "longitudinal" in that is extends along the length of the brush. It will be appreciated that when the comb surface 54 is described as being "flat," reference is made to its planar surface extending across the width of the profile comb as seen in FIG. 2, and that in the longitudinal direction shown in FIG. 3, the comb surface 54 follows the concave curvature of the twisted wire core 40. Because the profile comb 52 extends from the concave side of the twisted wire core, the bristles forming the profile comb 52 converge and provide a dense flat comb surface 54 that tends to resist accepting eyelashes between the bristles.

As best seen if FIGS. 2 and 5, the trim of the profile comb is such that the profile comb converges from the applicator bristles to the flat comb surface 54, i.e., the width of the comb surface is less than the diameter of the brush 12 at the transition between the applicator bristle 50 side of the brush and the profile comb 52 side of the brush. Adjacent the tip 42 of the twisted wire brush, the profile comb 52 is further trimmed to provide a beveled detail pad 56.

In the embodiment shown, the brush 12 has approximately 45–65 bristles per turn of the wire core 42, and has approximately sixteen turns along length of one inch. The radius of curvature R of the wire core is also one inch. The profile comb extends approximately 0.232 inches from the axis of the twisted wire core, and the applicator bristles extend approximately 0.105 of an inch from the twisted wire core, i.e., in a ratio of approximately 2:1. The width of the flat comb surface is 0.110 inches, i.e., approximately the length of the applicator bristles. The wiper 20 used with the brush 12 has a wiper orifice 22 with a diameter of 0.166 inches, or approximately one-half of the total width of the brush taken through the profile comb and applicator bristles.

Figure 6:
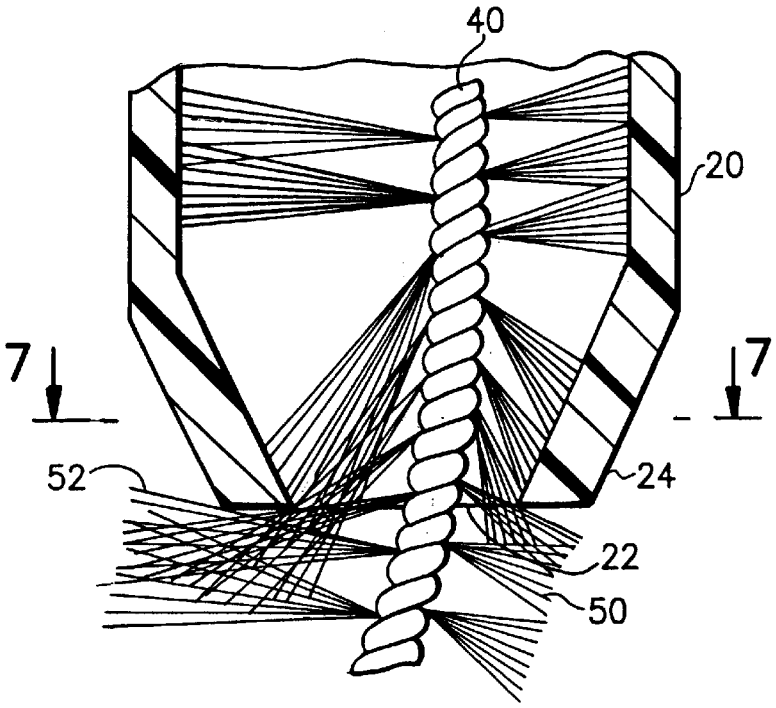
FIG. 6 is a schematic view of the mascara brush of FIG. 1 passing through the wiper of the mascara container of FIG. 1.
Figure 7:
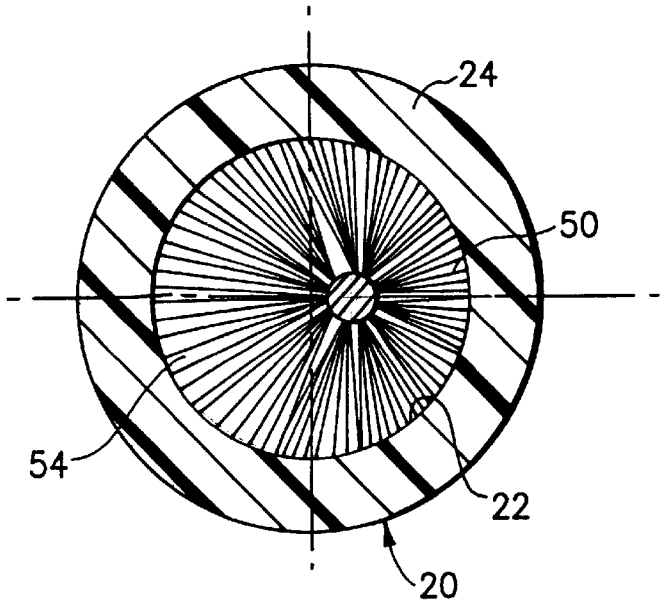
FIG. 7 is a sectional view of the mascara brush passing through the wiper, taken along the lines 7—7 of FIG. 6.

FIGS. 6 and 7 illustrate the interaction between the wiper 20 and the brush 12 as the brush is withdrawn from the cavity 16 of the cosmetics container body 14 through wiper orifice 22. Despite the bristles of the profile comb 52 being approximately twice as long as the applicator bristles 50, the core 40 is only displaced about 25% of the distance from the center of the orifice toward the periphery of the wiper orifice. Thus, the brush 12 is generally self-centered in the wiper orifice. This is because the applicator bristles 50, being shorter, tend to act in a relatively stiff manner, whereas the longer bristles of the profile comb 52 tend to bend more easily and with less resistance, so that they do not displace the brush in the orifice in proportion to their length.

This positioning of the bristles in the wiper orifice also results in different wiping action on the bristles of the profile comb 52 and the applicator bristles 50. After passing through the wiper orifice 22, a substantial amount of mascara remains on the applicator bristles 50 and the mascara is disposed relatively close to the ends of the applicator bristles. On the other hand, the more highly bent bristles of the profile comb 52 are essentially squegeed by the wiper and a substantial amount of the mascara is removed from the ends of these bristles.

Such wiping action is desirable in view of the manner of use of the brush 12. The brush 12 is well suited for applying lighter mascaras and particularly mascaras of the curling or building type. These mascaras dry quickly, and ideally the applicator brush can assist in positioning the eyelashes as the mascara dries to hold them in the desired position. Additional coats of mascara may be applied to better hold the eyelashes and to thicken them. When using the brush 12 with a curling or building mascara, the applicator bristles readily receive the eyelashes amongst them and coat them in a bath of mascara. The user of the brush 12 then turns the brush 180° to use the profile comb 52. The flat comb surface 54 is first used in one or more quick strokes to disperse the mascara evenly on the eyelashes, and is then used in a slow stroke to support the eyelashes and hold the eyelashes in the desired position while the mascara quickly dries. It will be appreciated that because the flat comb surface has a dense distribution of bristle ends, its combing action is achieved primarily with the surface of the brush and that the holding of the eyelashes is also achieved with the flat surface of the brush. The eyelashes are substantially supported on or near the flat comb surface 54 during this procedure.

Although the mascara dries quickly on the eyelashes, typically within three to five seconds for a curling or building product, it does not dry as quickly in the larger quantities carried by the applicator bristles 50. Therefore, the user can apply one or more additional coats of mascara without having to reinsert the brush 12 in the container body 14. Therefore, the applicator brush 12 effective and efficiently applies curling or building mascaras.

With reference to FIGS. 8 and 9, another mascara brush 70 according to the invention herein is shown. It is substantially similar to the brush 12, except the curve of the twisted wire core is disposed oppositely with respect to the bristles. Accordingly, brush 70 has a twisted wire core 72 which is curved in plane P, as seen in FIG. 9. The twisted wire core 72 has a radius of curvature R, which is one inch.

The brush 70 has applicator bristles 74 extending from the concave side of the twisted wire core 72 and a profile comb 76 extending from the convex side of the twisted wire core 72. Therefore, the applicator bristles 74 converge to have a somewhat denser distribution at their ends than at the wire core, and the bristles of the profile comb 76 diverge and have a less dense distribution at their tips than adjacent the twisted wire core. The profile comb 76 has a flat comb surface 78 defined by the ends of the bristles forming profile comb 76. The dimensions of the brush 70 are substantially the same as those of brush 12, except for the direction of curvature of the wire core.

Mascara brush 70 may also be used in conjunction with the mascara container 10 and applicator rod 30 described above. When passed through the wiper orifice 22 of the wiper 20, the brush 72 is wiped in substantially the same manner as the brush 12 described above, i.e., the brush 72 generally self-centers in the wiper orifice and a substantial amount of mascara remains on the applicator bristles 74 near the ends thereof while mascara is squegeed from the ends of the bristle forming the profile comb 76.

The brush 70 is well adapted to applying thicker lash-defining mascara formulations, which also generally have a slower drying time. The applicator bristles 74 may be used to place a substantial amount of mascara on the eyelashes. Because the mascara is of the heavier type, it is often deposited on the eyelashes in agglomerated portions. Thus, good combing action is required to spread the mascara evenly over the eyelashes. The less dense flat comb surface 76 with divergent bristles adjacent thereto permits the eyelashes to be wiped between bristles rather than by the tips thereof, which achieves the desired combing and spreading of the heavier mascara.

Another mascara brush 80 is shown in FIGS. 10 and 11. Mascara brush 80 illustrates another longitudinal profile trim, namely a fan shaped trim, which is well adapted for use in a curved longitudinal profile mascara brush to apply curling or building mascaras.

The mascara brush 80 has a twisted wire core 82 bent to a curve having a radius of about one inch. The twisted wire core mounts and supports bristles, which include applicator bristles 84 and bristles forming a longitudinal profile comb 86. The applicator bristles 84 extend from the convex side of the core, substantially similar to the applicator bristles 50 described above in brush 12. Thus, the applicator bristles 84 diverge from the wire core 82 and are thereby adapted to receive eyelashes between them for transferring mascara to the eyelashes. The profile comb 86, viewed from the end of the brush 80 as seen in FIG. 11, flares outwardly from the applicator bristles 84 to a wide, flat comb surface 88 that maximizes contact with eyelashes during the combing and holding steps in applying curling or building mascaras.

The brush 80 can also be modified for use with heavier mascaras by reversing the direction of curve of the core 82, so that the applicator bristles converge and the bristles defining the profile comb diverge toward the comb surface. It will also be appreciated that there are a wide variety of mascara products available and being developed, and that the mascara brushes described may be useful in applying mascaras other than the building or curling mascara and the heavier high definition mascaras. The mascara brushes described, by incorporating a curved core and a longitudinal profile comb, provide maximally different surfaces in a single brush, adapting the mascara brushes to multiple functions.

Accordingly, the preferred embodiments described above admirably achieve the objects of the invention. The preferred embodiments are illustrative of the invention herein, and it will be appreciated that various changes may be made without departing from the spirit and scope of the invention, which is limited only by the following claims.

What is claimed is:

1. A mascara brush comprising:

A) a twisted wire core securing bristles extending generally radially therefrom;

B) the bristles trimmed to define applicator bristles and bristles extending in an asymmetric longitudinal profile comb deployed along the core, the applicator bristles having a substantially uniform length and bristles defining the profile comb having a different, longer substantially uniform length; and C) the core curved in a plane passing through the profile comb, whereby bristles extending from the convex side of the curved core diverge and separate toward their ends and bristles extending from the concave side of the curved core converge and close together toward their tips.

2. A mascara brush as defined in claim 1 wherein the profile comb extends from the concave side of the curved twisted wire core.

3. A mascara brush as defined in claim 2 wherein the profile comb defines a flat comb surface across its width.

4. A mascara brush as defined in claim 3 wherein the bristles defining the profile comb have a length approximately two times the length of the applicator bristles.

5. A mascara brush as defined in claim 4 wherein the profile comb tapers inwardly toward its flat comb surface.

6. A cosmetics brush as defined in claim 5 wherein the flat comb surface has a width approximately equal to the length of applicator bristles.

7. A mascara brush as defined in claim 5 wherein the twisted wire core has a distal end, and the bristles defining the profile comb are further trimmed adjacent the distal end to define a detail pad descending angularly from the flat comb surface toward the distal end of the twisted core.

8. A mascara brush as defined in claim 5 wherein the bristles extend from the twisted wire core along a length of approximately one inch, and the curve of the twisted wire core has a radius of approximately one inch.

9. A mascara brush as defined in claim 8 wherein the twisted wire core has approximately sixteen turns per inch and the applicator bristles and bristles defining the longitudinal profile comb are formed of single strands passing through the twisted wire core at a bristle strand count in the range of 45 to 65 bristle strands per turn.

10. A mascara brush as defined in claim 9 wherein the bristles are hollow tubular bristles having a plurality of longitudinal ribs on their exterior surface, and having a diameter of approximately 0.005 inches.

11. A mascara brush as defined in claim 10 wherein the bristles have three longitudinal ribs.

12. A mascara brush as defined in claim 4 wherein the profile comb taper outwardly toward its flat comb surface.

13. A mascara brush as defined in claim 1 wherein the bristles defining a profile comb have a length of approximately two times the length of the applicator bristles.

14. A mascara brush as defined in claim 1 wherein the profile comb taper outwardly toward a flat comb surface defined across its width.

15. A mascara brush as defined in claim 1 wherein the profile comb extends from the convex side of the twisted wire core.

16. A mascara brush as defined in claim 15 wherein the profile comb defines a flat comb surface across its width.

17. A mascara brush as defined in claim 16 wherein the profile comb tapers inwardly toward its flat comb surface.

18. A mascara brush as defined in claim 16 wherein the profile comb tapers outwardly toward its flat comb surface.

19. A mascara brush as defined in claim 16 wherein the bristles extend from the twisted wire core along a length of approximately one inch and the twisted wire core has a radius of curvature of approximately one inch.

20. A mascara container comprising:

A) a body defining an elongated product cavity, the body including a threaded neck;

B) a wiper mounted in the neck, the wiper defining a wiper orifice providing entry to the elongated product cavity;

C) a cap with internal thread for removably securing the cap on the threaded neck of the body;

D) an applicator rod mounted to the cap and extending into the product cavity when the cap is on the body; and E) a mascara brush secured to the end of the applicator rod, the applicator brush having a curved core securing bristles extending radially therefrom, said bristles including shorter applicator bristles and longer bristles extending generally oppositely from the applicator bristles to define an asymmetric longitudinal profile comb, said profile comb encompassing a plane passing through the curved core.

21. A mascara container as defined in claim 20 wherein the twisted wire core has a shank at one end thereof secured to the applicator rod, and has a distal tip spaced from the shank, the distal tip and the shank being positioned generally along the axis of the applicator rod.

22. A mascara container as defined in claim 20 wherein the wiper is in the shape of a cone descending from the threaded neck of the body into the product cavity, said cone being truncated to define the wiper orifice.

23. A mascara container as defined in claim 22 wherein the bristles defining the profile comb have a length approximately two times the length of the applicator bristles.

24. A mascara container as defined in claim 23 wherein the wiper orifice has a diameter of approximately one-half the combined length of the applicator bristles and the bristles defining the profile comb.

25. A mascara brush as defined in claim 23 wherein the mascara brush is generally self-centered in the wiper orifice as it passes therethrough.

26. A mascara container as defined in claim 21 wherein the profile comb extends from the concave side of the twisted wire brush.

27. A mascara brush as defined in claim 26 wherein the profile comb tapers inwardly toward a flat comb surface extending across its width.

28. A mascara brush as defined in claim 27 wherein the twisted wire core has a distal end, and the bristles defining the profile comb are further trimmed adjacent the distal end to define a detail pad descending angularly from the flat comb surface toward the distal end of the twisted core.

29. A mascara container as defined in claim 27 wherein the bristles extend from the twisted wire core along a length of approximately one inch and the curve of the twisted wire core has a radius of approximately one inch.

30. A mascara brush as defined in claim 20 wherein the twisted wire core has approximately sixteen turns per inch and the applicator bristles and bristles defining the longitudinal profile comb are single filaments passing through the twisted wire core at a bristle count in the range of 45 to 65 bristles per turn.

31. A mascara brush as defined in claim 30 wherein the bristles are hollow tubular bristles having a plurality of lobes on their exterior surface, and having a diameter of approximately 0.005 inches.

32. A mascara brush as defined in claim 31 wherein the bristles have three longitudinal ribs.

33. A mascara container as defined in claim 26 wherein the profile comb tapers outwardly toward a flat comb surface extending across its width.

34. A mascara container as defined in claim 21 wherein the profile comb extends from the convex side of the twisted wire core.

35. A mascara container as defined in claim 34 wherein the profile comb tapers inwardly toward a flat comb surface extending across its width.

36. A mascara container as defined in claim 34 wherein the profile comb tapers outwardly toward a flat comb surface extending across its width.

* * * * *